United States Patent [19]

Lockard

[11] Patent Number: 4,737,118

[45] Date of Patent: Apr. 12, 1988

[54] HERMAPHRODITIC FLAT CABLE CONNECTOR

[75] Inventor: Joseph L. Lockard, Harrisburg, Pa.

[73] Assignee: AMP Incorporated, Harrisburg, Pa.

[21] Appl. No.: 9,055

[22] Filed: Jan. 27, 1987

Related U.S. Application Data

[63] Continuation of Ser. No. 811,613, Dec. 20, 1985, abandoned.

[51] Int. Cl.[4] ..... H01R 25/00

[52] U.S. Cl. ..... 439/289; 439/594; 439/660

[58] Field of Search ..... 339/49 R, 49 B, 48, 339/47, 59 R, 59 M, 176 M, 176 MF

[56] References Cited

U.S. PATENT DOCUMENTS

| | | | |
|---|---|---|---|
| 3,065,447 | 11/1962 | Maurer | 339/184 |
| 3,091,746 | 4/1963 | Winkler | 339/47 |
| 4,335,931 | 6/1982 | Kinnear | 339/49 R |
| 4,403,821 | 9/1983 | Zimmerman, Jr. et al. | 339/49 R |
| 4,501,459 | 2/1985 | Chandler et al. | 339/176 M |
| 4,537,456 | 8/1985 | Brown et al. | 339/99 R |
| 4,552,425 | 11/1985 | Billman | 339/47 R |
| 4,602,833 | 7/1986 | Grabbe et al. | 339/49 R |
| 4,632,121 | 12/1986 | Johnson et al. | 339/75 R |

FOREIGN PATENT DOCUMENTS

| | | | |
|---|---|---|---|
| 1280477 | 7/1972 | United Kingdom | 339/47 R |

*Primary Examiner*—Gil Weidenfeld
*Assistant Examiner*—Paula A. Austin
*Attorney, Agent, or Firm*—Anton P. Ness

[57] ABSTRACT

A connector for transmission cable has a lower housing and an upper housing securable thereto to be terminated to a prepared end portion of the cable. The conductors are laser welded in slots of the terminals. The contact sections of the terminals reside on respective resilient supports of the lower housing which act in cantilever fashion. A hood section of the upper housing extends over the plurality of contact sections to define a cavity. The connector structure is hermaphroditic in that one connector is matable with another identical connector having a reversed vertical orientation. The respective hoods cooperate to resist the forced cantilever action of the pairs of resilient supports urging each other apart, thus generating contact normal force. The hermaphroditic connectors latch when fully mated.

20 Claims, 6 Drawing Sheets

30
36
38
44
88
82
90
86
74
90
88
82
34
32
48
42
46
40
20
92
26
62
60
58
48
24
22
42
46
44
38
36
28

HERMAPHRODITIC FLAT CABLE CONNECTOR

This application is a continuation of application Ser. No. 811,613 filed Dec. 20, 1985, now abandoned.

FIELD OF THE INVENTION

The present invention is related to the field of electrical connectors and more particularly to connectors for ribbon cable.

BACKGROUND OF THE INVENTION

Connectors are known for terminating flat cable having round wire conductors, utilizing contact terminals which are electrically connected to the conductors by soldering, by crimping or by insulation displacement. These techniques work well for the types of cable conventionally known. However, with the entry of cable having smaller sized, more closely spaced conductors such techniques become difficult and less reliable, at the same time that there is increased desire for higher integrity signal transmission.

Specifically, it is desirable to provide a termination of small sized closely spaced conductors of a cable which is an assured and reliable termination.

It is further desirable to provide a connector which is matable with itself.

It is additionally desirable to provide as short a distance between insulated portions of two cables as possible by decreasing the length of the contact terminals, to minimize impedance discontinuity.

And it is also desirable to reduce the amount of metal contained in the contact terminals to optimize impedance matching of the transmitted signals.

SUMMARY OF THE INVENTION

The connector assembly of the present invention is hermaphroditic and comprises an upper and a lower housing member which are securable to each other, with an end portion of a ribbon cable therebetween having contact terminals terminated to its conductors such as by laser welding, preferably. The contact terminals are disposed along the lower housing member and the more particularly have contact sections disposed along surfaces of respective resilient supports extending forwardly from the lower housing. A hood extends forwardly from the upper housing opposed from the contact terminals and defining a large cavity of selected height.

The large cavity between the contact terminals and the upper housing hood receives the plurality of contact terminals and their respective resilient supports of a mating connector assembly of identical construction and reversed vertical orientation. The hoods of each connector extend behind the resilient supports of the other connector and latch upon complete mating engagement. The resilient supports have tapered outer surfaces and during mating urge each other relatively outwardly cantilever fashion in a direction normal to the mating axis and against the hoods; the hoods and the resilient nature of the supports provide resistance to such movement and generate substantial contact normal force. The forward ends of the contact terminals are angled to engage each other and provide for wiping action upon mating.

The contact terminals may be thin and narrow for impedance matching benefits, with contact force being provided substantially by the respective housings of the connectors. In an alternate embodiment, an assist spring member may be secured along the inside surface of the hoods, which continues to provide contact normal force after long in-service use of the connector.

A connector of the present invention may also be used to terminate a plurality of individual cables, if desired, and may also mate with a connector having the identical forward structure mounted on a printed circuit board instead of being terminated to a ribbon cable.

BRIEF DESCRIPTION OF THE DRAWINGS

FIG. 8 is a part perspective view of an assist spring for use in an alternate embodiment of the invention.

DETAILED DESCRIPTION OF THE PREFERRED EMBODIMENT

Figure 1:
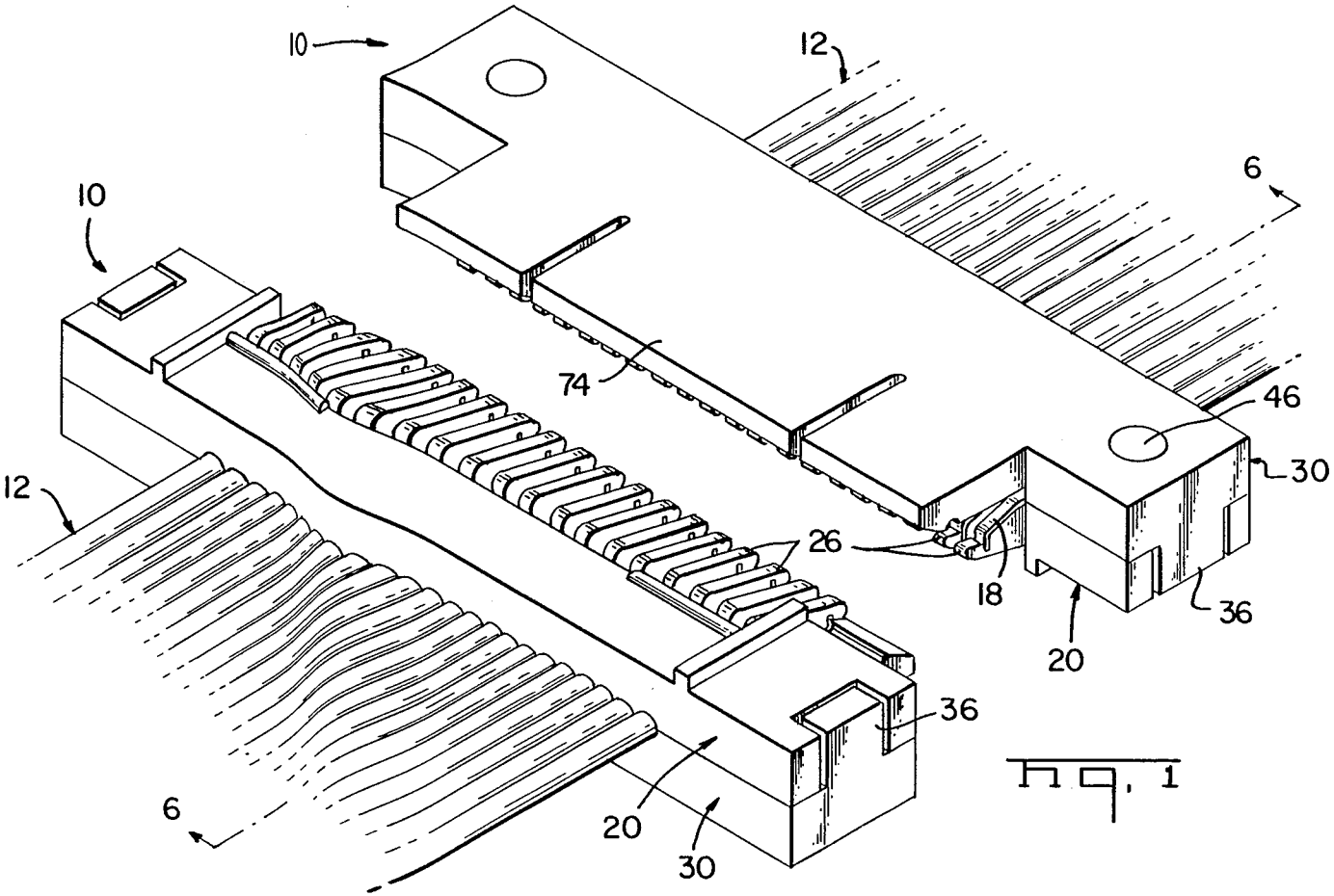
FIG. 1 is a perspective view of two connector assemblies of the present invention matable with each other.
Figure 2:
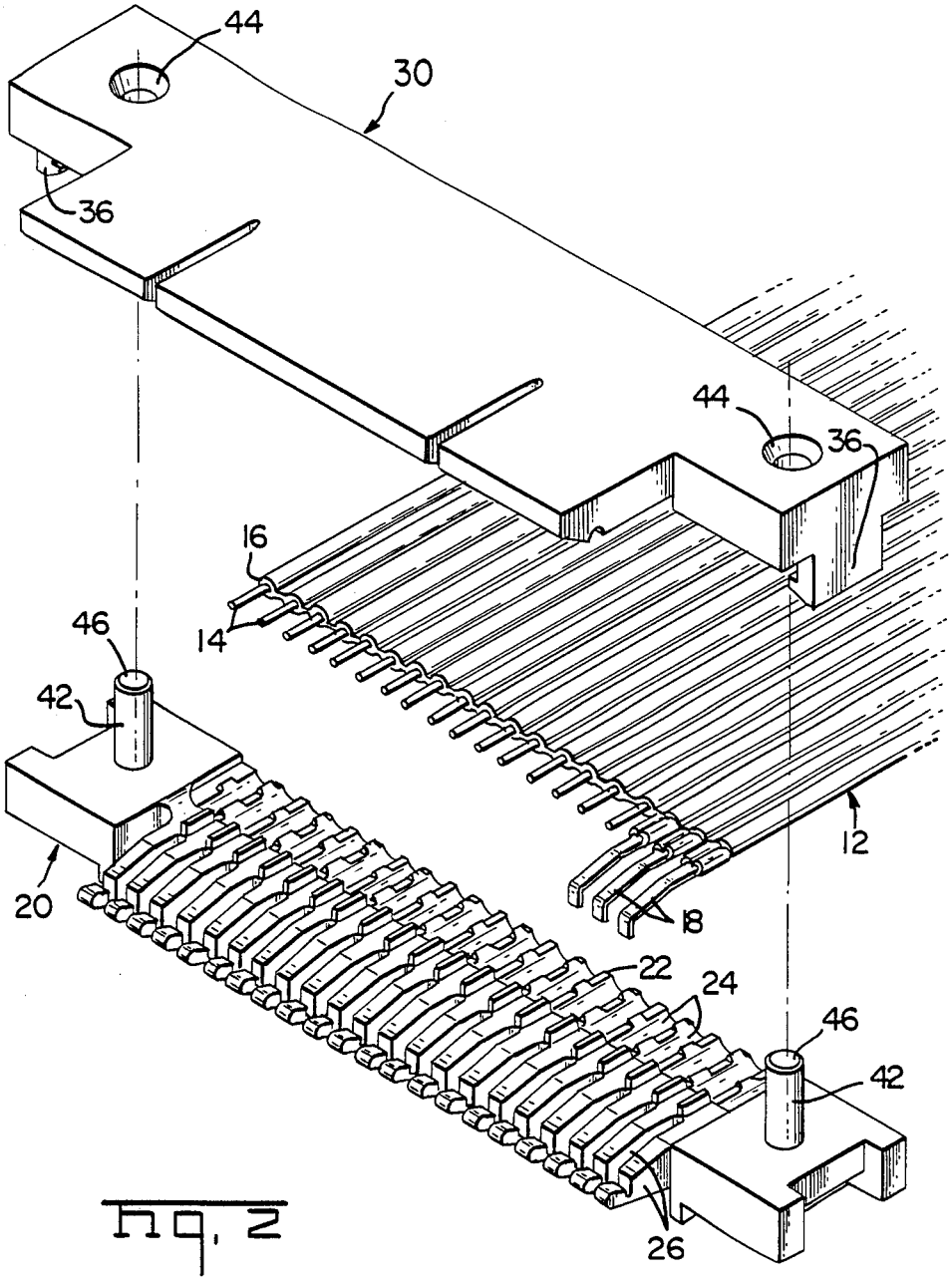
FIG. 2 shows a connector assembly of FIG. 1 with the terminated cable and housing members exploded apart.
Figure 3:
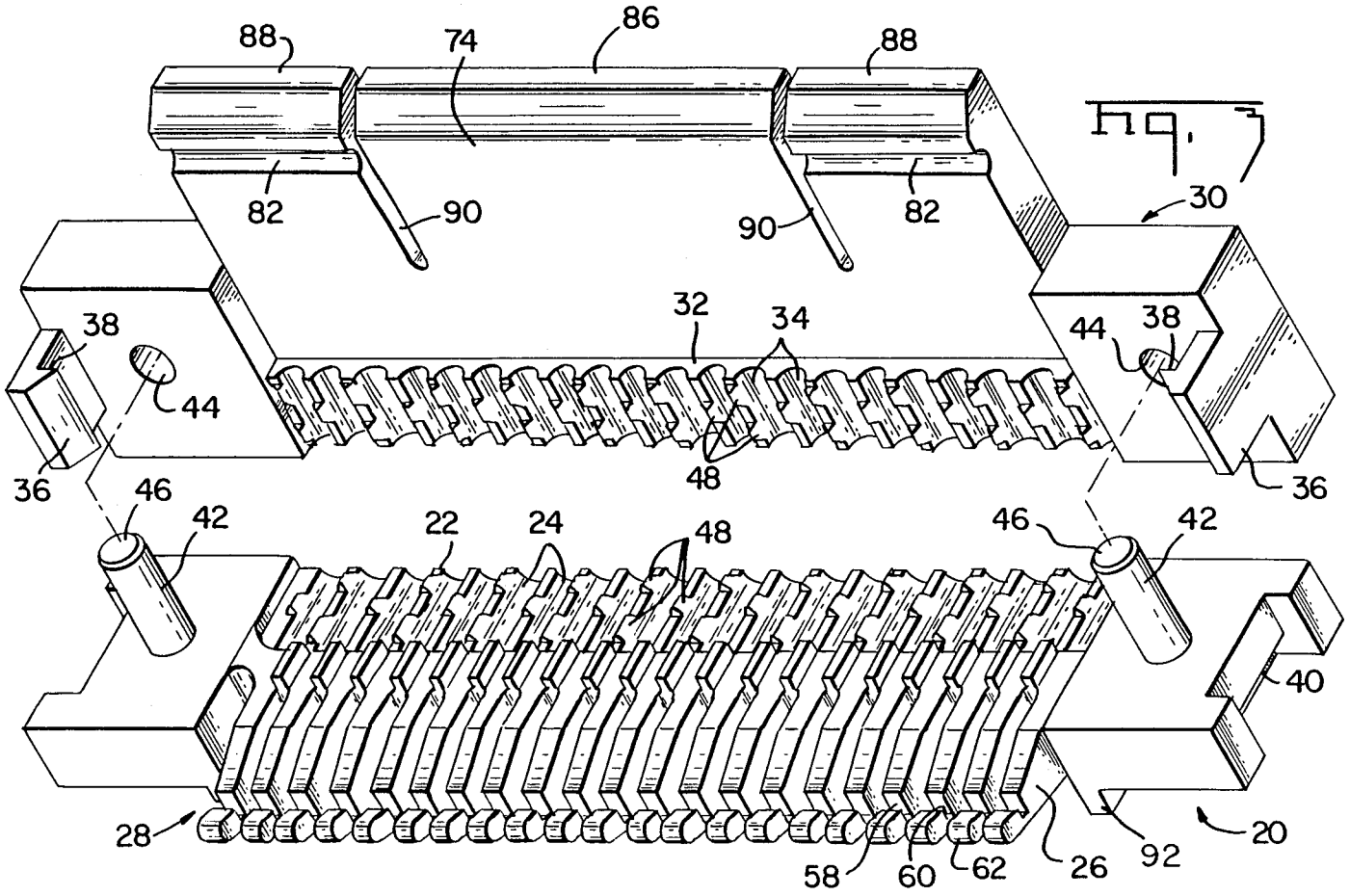
FIG. 3 is a perspective view of the profiled interiors of the two housing members of FIG. 2.

The connector assembly of the present invention is hermaphroditic, capable of mating with an identical connector. FIG. 1 shows two connector assemblies 10 of the present invention each terminating a ribbon cable 12. In FIG. 2 cable 12 has a plurality of conductor wires 14 embedded in an insulative jacket 16 which typically is extruded thereover. A stripped end of each conductor 14 is terminated to a contact terminal 18. With reference to FIGS. 2 and 3, premolded dielectric lower housing member 20 has a rear portion 22 which has a contour to engage the surface of cable 12 for cable-gripping and strain relief, which contour may comprise arcuate channels 24 at each conductor location. Forwardly of each channel 24 is a resilient contact support section 26 extending to the mating face 28 of lower housing member 20. Premolded dielectric upper housing member 30 has a raised rear portion 32 contoured to engage the surface of cable 12, such as by arcuate channels 34.

Upper housing 30 is latchably securable to lower housing member 20 when terminated cable 12 is placed therebetween, to form a connector assembly 10. Latch arms 36 at each end of upper housing member 30 have latches 38 which latch over a ledge 40 proximate the bottom of lower housing member 20 to secure together the upper and lower housing members. Posts 42 of lower housing member 20 extend upwardly through holes 44 of upper housing member 30, and after the housings are latched together ends 46 of posts 42 preferably are enlarged such as by being deformed by heat staking or cold staking to permanently secure the housings together, as seen in FIG. 1. To assist in gripping cable 12 after assembly it is preferred that housings 20,30 have a plurality of sharp projections 48 which bite into cable jacket 16. Other conventional means may be used to secure the upper and lower housings together.

Figure 4:
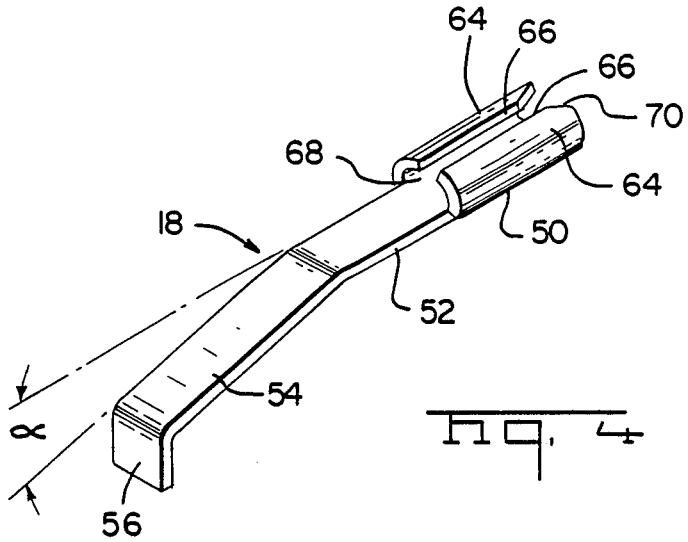
FIGS. 4 and 5 show a preferred terminal and termination thereof to a conductor.
Figure 5:
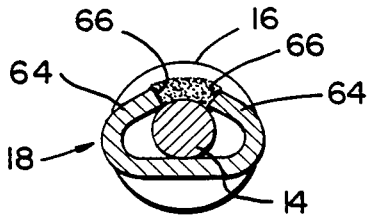

The preferred type of terminal 18 and the preferred method of termination to a conductor 14 is shown in FIGS. 4 and 5. Terminal 18 has a conductor-connecting section 50, a planar body section 52 forwardly thereof, a contact section 54 extending at a slight angle $\alpha$ downwardly from body section 52, and an end section 56 extending downwardly from contact section 54. Angle $\alpha$ may be about 5° to about 25° and is preferably about 15°. End section 56 engages forwardly facing surface 58 of resilient support 26 when placed on lower housing 20 during assembly and extends into retention slot 60, more clearly shown in FIG. 7. Rounded end section 62 of resilient support 26 extends forwardly from retention slot 60 and provides protection for contact sections 54 when unmated and during mating, while also assisting in aligning the connectors 10 during mating.

Figure 6:
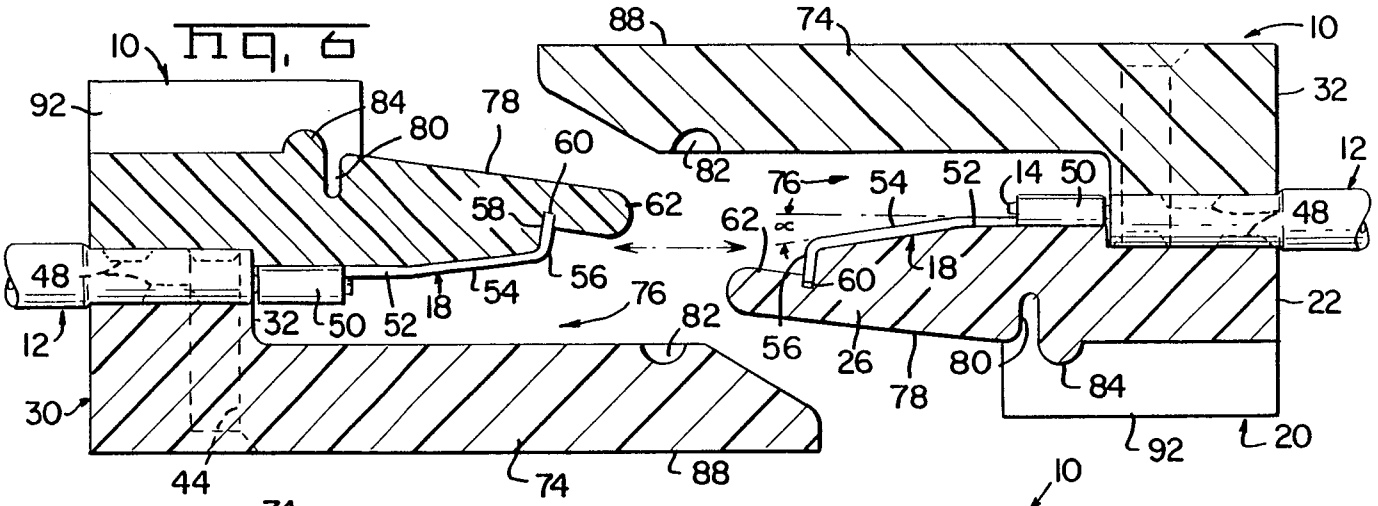
FIGS. 6 and 7 are longitudinal section views of the connector assemblies of FIG. 1 being mated, with FIG. 6 taken along line 6—6 of FIG. 1.
Figure 7:
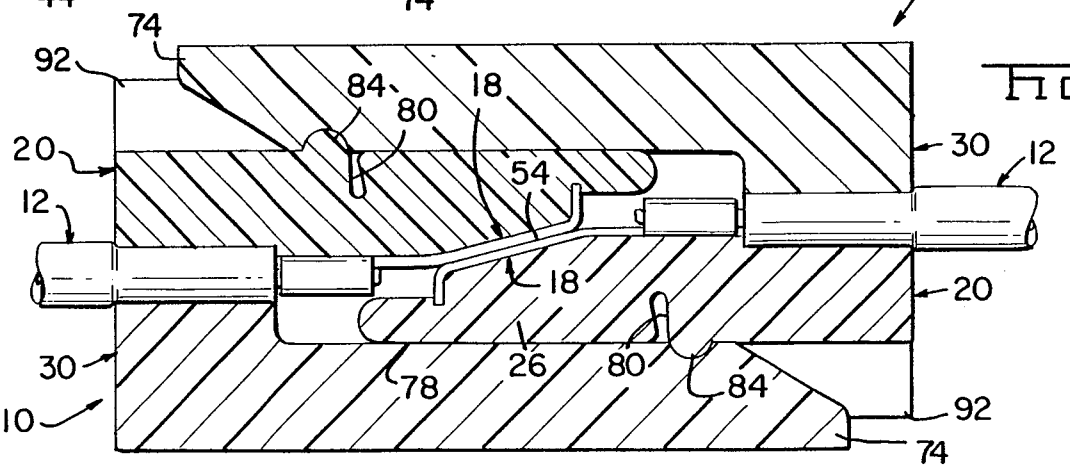

Conductor-connecting section 50 of terminal 18 preferably is formed having walls 64 bent upwardly and inwardly such that their ends 66 face each other spaced apart a distance D defining a conductor-receiving slot 68. Slot 68 preferably has a lead-in 70 at the rearward end. Distance D is selected to be slightly smaller than the diameter of a conductor 14. A conductor 14 is preferably terminated to a terminal 18 by first being pressed into slot 68 and temporarily secured therein by interference fit. Then conductor 14 is laser welded to terminal 18 such as is disclosed in U.S. patent applications Ser. Nos. 769,552 filed Aug. 26, 1985 and 652,778 filed Sept. 19, 1984, assigned to the assignee hereof. Upper housing 30 includes a hood section 74 extending forwardly from raised rear portion 32 to be opposed from contact sections 54 and resilient supports 26 of lower housing 20, together defining a large cavity 76 therebetween. Referring especially to FIGS. 6 and 7, cavity 76 is dimensioned to receive thereinto the contact sections and resilient supports of an identical connector assembly 10 upon mating therewith, in a tight fitting manner. Resilient supports 26 have tapered outer surfaces 78 extending forwardly from a deep transverse groove 80 which construction enables reslient support 26 to act in cantilever spring fashion when forced outwardly. The hood sections 74 of each of the respective mating connectors 10 extend behind resilient supports 26 of the other of the connectors 10 to oppose the outward cantilever movement of resilient supports 26 during mating. This combined resistance of resilient supports 26 and hoods 74 provides substantial contact normal force to generate an appropriate electrical connection between the respective mating pairs of contact sections 54. Furthermore, because of the slightly angled design of contact sections 54, wiping action occurs during mating to scrape away any oxides on the contact surfaces of contact sections 54 to provide an appropriate electrical connection.

At the forward end of hood section 74 are located lengths of arcuate transverse grooves 82 to receive thereinto corresponding arcuate rib segments 84 of lower housing 20 just rearwardly of deep groove 80, when full mating of connectors 10 has occurred, to resist axially unmating movement. To assist in guiding the connectors when being mated, guideways 92 are disposed at lateral ends of the lower housing 20 adjacent the row of resilient supports 26 which are axially extending ribs, between which hood section 74 of the mating connector's upper housing 30 will be disposed in a close fit to accurately position the mating contact sections 54 laterally with respect to each other. It may be desirable to provide a taper at each corner of hood section 74 to act as a lead-in.

Hood section 74 preferably has a central section 86 spaced from lateral sections 88 by axially extending slots 90. In this way latching of connectors 10 may occur proximate the ends of connectors 10 by rib segments 84 at each end in corresponding lengths of groove 82, instead of entirely across connectors 10. During latching lateral hood sections 88 provide a tactile indication of full latching and also a visible indication by enabling comparison with central hood sections 86.

Hood section 74 and resilient supports 26 are preferably thick to provide substantial stiffness, and lower and upper housings 20,30 are preferably premolded from thermoplastic such as polyetherimide for resistance to creep during long term in-service usage.

When fully mated, contact sections 54 extend substantially axially forwardly of respective conductors 14 to engage corresponding mating contact sections, and the total distance between the ends of insulative jackets 16 of the two cables 12 is minimized. This construction is believed to reach an optimum minimum in impedance discontinuity between the cables.

Figure 9:
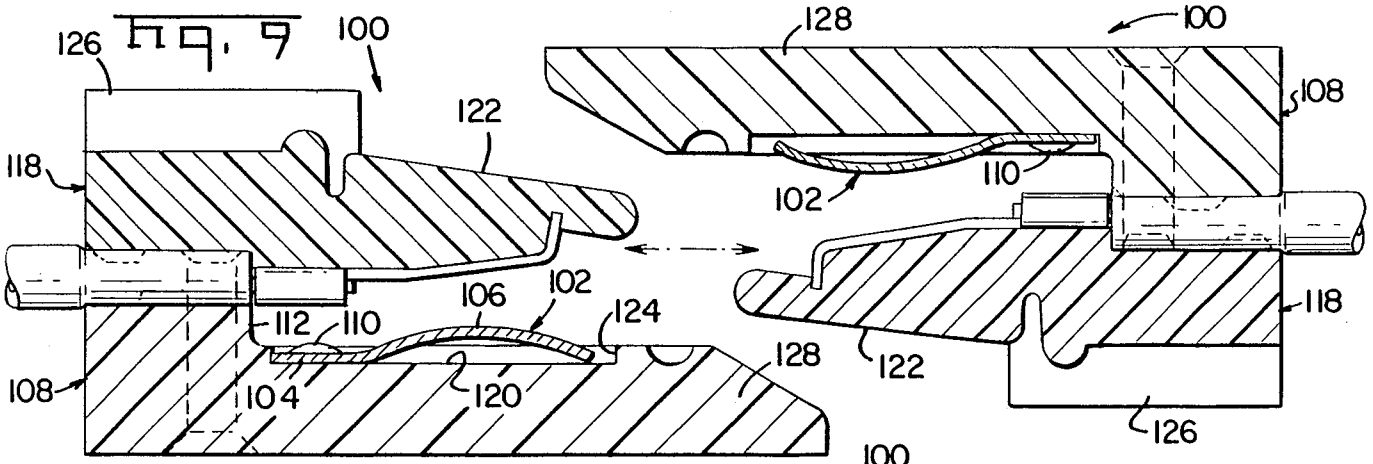
FIGS. 9 and 10 are longitudinal section views of an alternate embodiment of the connector assemblies of the invention being mated, using the assist spring of FIG. 8.
Figure 10:
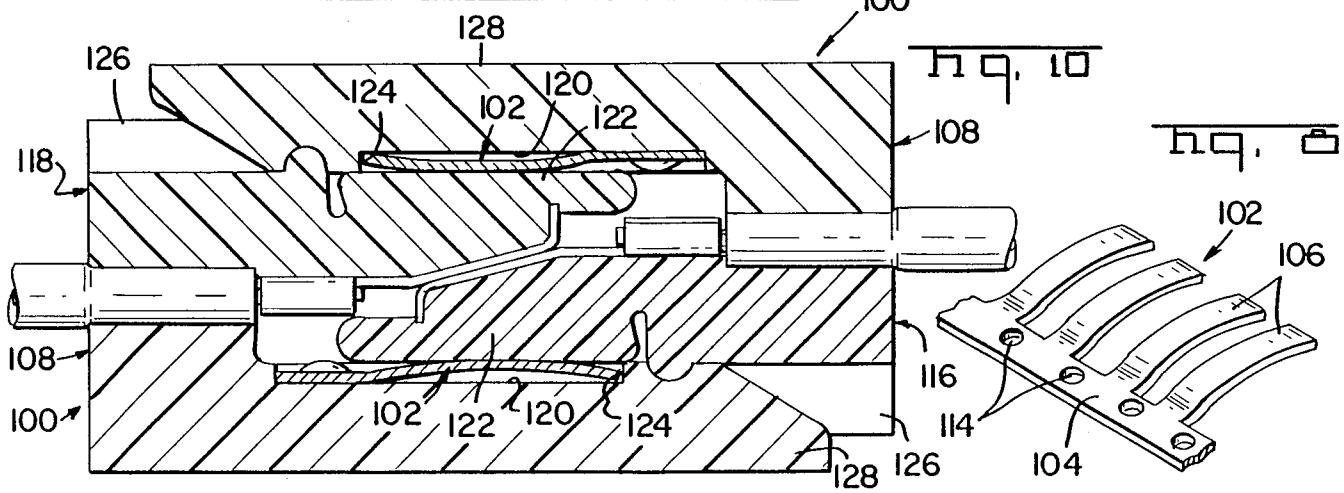

FIGS. 8 through 10 illustrate an alternate embodiment of the connector assembly of the present invention, wherein connector assembly 100 utilizes an assist spring 102 comprising a body section 104 forwardly from which extend a plurality of gently arcuate fingers 106. Assist spring 102 may be mounted in upper housing 108 of connector 100 by projections 110 proximate rear housing portion 112 extending through holes 114 through body section 104 after which their ends are enlarged such as by heat staking or cold staking to secure assit spring 102 to upper housing 108 prior to assembly to lower housing 118 to form connector 100. Assist spring 102 preferably is disposed in a shallow recess 120 which extends forwardly a selected distance beyond the ends of fingers 106. With such a construction, fingers 106 may extend forwardly when they are deflected by respective resilient supports 122 during mating, engage a stop surface 124, and thus be kept in an arcuate shape and provide spring strength to resilient supports 122. Assist spring 102 may be preferably made of creep-resistant spring metal such as stainless steel. Guideways 126 are provided on lower housing 118 to receive hood section 128 of upper housing 108 of a mating connector 100 therebetween.

The connectors of the present invention can be shielded if desired such as by metal-plating the housing member or by using a die cast metal shell therearound, in electrical engagement with a selected ground terminal or a ground shield of the cable, or a ground conductor of the cable which could be exposed by selective stripping. For instance, one of the projections 48 on upper housing 30 could be plated and be electrically connected to the metal shield around upper housing 30, and electrically engage an exposed ground conductor or ground shield of the cable upon assembly.

Benefits are obtained from the present invention in that impedance control is assisted by reason of the short path from the insulated portion of one cable to the insulated portion of the other cable through the mated connector assembly. The stripped lengths of conductors are short and the contact length of the engaged contact pairs is short between the termination joints of the respective conductors. The amount of bulk metal is small, and the resultant decrease in spring strength of the mated pairs of contacts for generation of sufficient contact normal force, is replaced by spring strength in the resilient contact supports of the housings.

The use of laser welding provides assured and reliable termination of the small diameter conductor wire to the terminal. The weld joints are as strong as the wire, the electrical connection to the terminal is about as large as the wire diameter, and the connection will not deteriorate due to vibration. The preparation of the cable end, the wiping of conductors into slots and the laser welding by precise computer control are easily incorporated into an automated cable harness assembly. The resistance of the welded wires at their termination is smaller and more uniform than that of conventional slot terminated wires. The elimination of tine projections from conventional slotted beam terminals eliminates geometry which may act as antennae, and thus substantially lessen reflection and crosstalk. With small diameter wires presently desired in transmission cables, there is less resistance to compression by slotted beam termination, which compression is needed therein to provide a gas tight interface. And the tolerance allowances in stamping the slotted beam of such a terminal must be very small which is practically very difficult to maintain.

Modifications may be made to the present invention, such as in the manner of delatchable latching or in shielding or in cable strain relief, which are within the spirit of the invention and the scope of the claims.

What is claimed is:

1. A hermaphroditic electrical connector for electrical transmission cable means having conductor means, said connector comprising:

a lower dielectric housing means having a transverse cable-receiving rearward portion and a plurality of resilient contact support means integral therewith and extending forwardly therefrom;

an upper dielectric housing means having a cooperating transverse cable-receiving rearward portion proximate said cable-receiving rearward portion of said lower housing means, and further having a hood means extending forwardly therefrom opposed from said contact support means of said lower housing means, said hood means and said contact support means defining a cavity therebetween having a selected height;

a like plurality of contact terminals terminated to respective conductor means of the transmission cable means and disposed on respective said resilient contact support means;

means securing said upper housing means to said lower housing means with an end portion of said transmission cable means secured therebetween and said contact terminals secured therein to form said electrical connector; and means for latching said electrical connector to a like mating electrical connector having reversed vertical orientation;

each said contact terminal including a contact section disposed against a respective said contact support means and a conductor-connecting section rearwardly thereof to which is terminated a respective one of said conductor means;

each said contact section being slightly angled downwardly at the forward end thereof and disposed against a correspondingly tapered surface of said respective contact support means and said respective contact support means being urgeable downwardly in cantilever fashion away from said hood means of said upper housing means during mating of said electrical connector with said like mating electrical connector by the engagement of a corresponding contact section of a corresponding contact terminal of said mating electrical connector, upon entry of said plurality of resilient contact support means having respective said contact sections thereon, of each of said connector and said like mating connector into said cavity of the other thereof; and said hood means of each of said connector and said like mating connector providing resistance to the cantilever movement of the contact support means of the other thereof upon full mating of said electrical connector and said like mating electrical connector whereby substantial contact normal force is generated between mating pairs of said contact sections and said corresponding contact sections.

2. A hermaphroditic electrical connector as set forth in claim 1 wherein said lower housing means includes a transverse groove means along an outer surface thereof forwardly of said rearward portion, said contact support means extend forwardly of said transverse groove means, and outer surfaces of said contact support means are slightly tapered inwardly, said transverse groove means and said slightly tapered outer surfaces of said contact support means permitting outward cantilever deflection thereof against a said hood means of said mating connector during mating.

3. A hermaphroditic electrical connector as set forth in claim 1 wherein said contact support means have rounded forward ends which enter the cavity of the mating connector and facilitate guiding said contact support means along said corresponding contact sections of said corresponding contact terminals of said mating connector.

4. A hermaphroditic electrical connector as set forth in claim 1 wherein said hood means has a tapered surface at the forward end of the inner surface thereof as a lead-in during mating of said connector with said mating connector.

5. A hermaphroditic electrical connector as set forth in claim 1 further including cable-engaging projections extending from said cable-receiving rearward portion of said lower housing means and from said cooperating cable-receiving rearward portion of said upper housing means, said projections biting into the cable jacket of said transmission cable means upon assembly to provide cable strain relief.

6. A hermaphroditic electrical connector as set forth in claim 1 further comprising an assist spring means disposed along and secured to an inner surface of said hood means to engage outer surfaces of said contact support means of said mating electrical connector to provide resistance to said cantilever movement thereof.

7. A hermaphroditic electrical connector as set forth in claim 6 wherein said assist spring means is secured to said inner surface of said hood means by means of projections from said inner surface extending through corresponding hole ends thereof in said assist spring means and being deformably enlarged.

8. A hermaphroditic electrical connector as set forth in claim 6 wherein said assist spring means includes a body portion at a rearward end thereof forwardly from which extend a plurality of parallel spaced fingers associated with contact support means of a said mating connector, said fingers having a gentle arcuate shape outwardly from said inner surface of said hood means of said upper housing means.

9. A hermaphroditic electrical connector as set forth in claim 8 wherein said assist spring means is disposed in a recess means of said inner surface of said upper housing means, and said arcuate fingers extend outwardly of said recess means with free ends of said fingers being disposed in a forward portion of said recess means.

10. A hermaphroditic electrical connector as set forth in claim 9 wherein said recess means includes a stop surface at a forward end thereof whereagainst said free ends of said arcuate fingers abut upon mating of a said connector with a said mating connector to keep said fingers in an arcuate shape when stressed by respective said contact support means of said mating connector.

11. A hermaphroditic electrical connector as set forth in claim 1 wherein each said contact terminal includes an end section extending downwardly from the front of said contact section and being disposed against a forwardly facing surface of a respective said contact support means.

12. A hermaphroditic electrical connector as set forth in claim 11 wherein said end section is disposed in a respective retention slot in said respective contact support means.

13. A hermaphroditic electrical connector as set forth in claim 1 wherein said latching means comprises transverse groove means at a forward end of an inner surface of said hood means of said connector and said mating connector respectively, and corresponding transverse rib means across an outer surface of said lower housing means of said mating connector and said connector respectively, said rib means being located rearwardly of said contact support means and being latchably received in said transverse groove means upon mating of said connector and said mating connector, said hood means of each of said connector and said mating connector being resilient and riding over said rib means of the other of said connector and said mating connector during mating and being urged outwardly thereby until said rib means is received in said transverse groove means.

14. A hermaphroditic electrical connector as set forth in claim 13 wherein said rib means comprise aligned spaced lengths of rib segments proximate lateral ends of said lower housing means and said hood means comprises a central section and lateral sections on each side thereof and spaced therefrom by axially extending slots, said lateral sections including said transverse groove means corresponding to said rib segments, said central section of said hood means not being urged outwardly by said corresponding rib segments during mating of said connector and said mating connector.

15. A hermaphroditic electrical connector as set forth in claim 1 wherein said connector includes guide means for guiding said mating connector along an axial direction during mating and aligning said mating connector with said connector so that said corresponding contact sections of said corresponding contact terminals are aligned with said contact sections of said contact terminals.

16. A hermaphroditic electrical connector as set forth in claim 15 wherein said guide means comprise axially extending ribs at lateral ends of said lower housing means, and said hood means of said upper housing of said mating connector is disposed therebetween in a close fit during mating.

17. A hermaphroditic electrical connector as set forth in claim 1 wherein said securing means comprises posts at lateral ends of one of said lower housing means and said upper housing means extending through corresponding holes in the other of said lower and said upper housing means and ends of said posts being deformably enlarged to secure said lower and said upper housing means together.

18. A hermaphroditic electrical connector as set forth in claim 17 further including latch arms at lateral ends of one of said lower and said upper housing means latching over corresponding ledge means of the other of said lower and said upper housing means during assembly thereof.

19. A hermaphroditic electrical connector as set forth in claim 1 wherein said conductor-connecting section of each said contact terminal comprises a pair of spaced apart axially extending wall means defining a conductor-receiving slot, said slot having a width slightly less than a said respective one of said conductor means such that said respective one of said conductor means is wiped thereinto to be held in said slot in interference fit prior to being terminated by being laser welded to said contact terminals.

20. A hermaphroditic electrical connector as set forth in claim 19 wherein said wall means comprise ends of walls which are bent upwardly and inwardly such that said ends face each other.

* * * * *